US005887863A

United States Patent [19]

Hollenstein et al.

[11] Patent Number: 5,887,863

[45] Date of Patent: Mar. 30, 1999

[54] METHOD FOR PRODUCING BOOK BLOCKS COMPOSED OF FOLDED PRINTED SHEETS

[75] Inventors: Hans Hollenstein, Guntershausen; Heinz Bötschi, Mauren, both of Switzerland

[73] Assignee: Grapha-Holding AG, Hergiswil, Switzerland

[21] Appl. No.: 793,528

[22] PCT Filed: Jul. 1, 1996

[86] PCT No.: PCT/CH96/00260

§ 371 Date: Feb. 27, 1997

§ 102(e) Date: Feb. 27, 1997

[87] PCT Pub. No.: WO97/03906

PCT Pub. Date: Feb. 6, 1997

[30] Foreign Application Priority Data

Jul. 24, 1995 [CH] Switzerland ..... 2 166/95

[51] Int. Cl.[6] ..... B65H 39/00

[52] U.S. Cl. ..... 270/52.18; 270/58.02

[58] Field of Search ..... 270/52.18, 52.27, 270/58.02, 52.29, 52.23

[56] References Cited

U.S. PATENT DOCUMENTS

| | | | |
|---|---|---|---|
| 4,486,011 | 12/1984 | Rhunke | 270/55 |
| 4,811,938 | 3/1989 | Hansch | 270/54 |
| 4,989,850 | 2/1991 | Weller | 270/54 |
| 5,114,128 | 5/1992 | Harris, Jr. et al. | 270/54 |
| 5,131,648 | 7/1992 | Ito | 271/262 |
| 5,137,409 | 8/1992 | Honegger | 270/53 |
| 5,231,918 | 8/1993 | Grzwna | 99/295 |
| 5,461,469 | 10/1995 | Farrell et al. | 355/321 |
| 5,667,212 | 9/1997 | Merkli | 270/52.16 |
| 5,678,813 | 10/1997 | Osako et al. | 270/52.18 |

FOREIGN PATENT DOCUMENTS

| | | |
|---|---|---|
| 0 327 822 | 8/1989 | European Pat. Off. . |
| 2107385 | 9/1972 | Germany . |
| 35 12 920 | 1/1986 | Germany . |
| 3806125 | 9/1989 | Germany . |
| 38 01 896 | 10/1989 | Germany . |
| 2 111 377 | 7/1983 | United Kingdom . |
| WO 93/05692 | 4/1993 | WIPO . |

*Primary Examiner*—John T. Kwon
*Attorney, Agent, or Firm*—Venable; George H. Spencer; Robert Kinberg

[57] ABSTRACT

In order to recognize the open position of printed sheets supplied one after the other astride on a transfer apparatus to a sewing apparatus of a thread stitching machine, the printed sheets are guided in straddled position on at least one of the sides forming the inner fold edge of a printed sheet past a checking apparatus carrying out checks by way of the print images.

6 Claims, 2 Drawing Sheets

METHOD FOR PRODUCING BOOK BLOCKS COMPOSED OF FOLDED PRINTED SHEETS

BACKGROUND OF THE INVENTION

The invention relates to a method for producing book blocks composed of folded printed sheets, wherein the printed sheets having different print images are supplied separately according to a specific sequence to the sewing apparatus of a thread stitching machine and are stitched to one another by at least one twine which extends through the fold of the printed sheets.

Methods of this type serve to produce books of a high binding quality.

The various folded printed sheets forming the book blocks are made available in stacked form in multiple copies in a specific sequence according to the contents of the book block to be produced and they are fed one after the other through a separating apparatus onto a processing section.

On the way to the sewing apparatus of the thread stitching machine, which, as is known, is configured of different sewing systems, the printed sheets run through a station in which they are checked for correctness and processing readiness. For the processing in the sewing apparatus, they are opened upstream of this station and fed in astride manner to a saddle-shaped support where they are taken over by carriers of a circulating conveying arrangement.

A reading apparatus, which is directed at the saddle-shaped support from the outside determines which printed sheet is involved which is subsequently checked in a comparison apparatus connected to the reading apparatus. The comparison apparatus signals to a control if a sheet is faulty. If this is the case, the processing process is stopped and the faulty printed sheet is replaced. The comparison apparatus comprises the data of the desired values for the printed sheets destined for a complete book block as well as on their sequence; the required data are picked up or stored in a preceding calibration process.

This manner of recognizing the printed sheets makes it possible to ensure the sequence of the printed sheets and the correctness.

The recognition of whether the folded printed sheets are opened correctly before they are transferred to the stitching process remains unsolved. The result of an incorrectly opened printed sheet would be that it is only partially grasped in the sewing process and subsequently not anchored in the bound book block. It does occur that a printed sheet is not opened in the center before it is deposited on the saddle-shaped support so that only a portion of the inner fold edges is resting on the stitching saddle or only a portion of the folds is grasped during the sewing. The printed sheets which were not grasped sit loosely between the bound printed sheets; thus, a book turns out to be useless.

SUMMARY OF THE INVENTION

Therefore, it is an object of the present invention to ensure that, during the processing of printed sheets into book blocks by means of thread stitching, the open condition of a printed sheet is detected while complying with the known conditions.

This object is solved according to the invention in that, on the conveying path to the sewing apparatus, the printed sheets are guided in straddled position on at least one of the sides forming the inner fold edge of the printed sheets past a checking apparatus which, by way of the print images, checks the type of sheet or the completeness and/or processing position, by means of which, inter alia, the reliability of the processing process can be increased.

It is particularly advantageous in this process if the print images of the printed sheets are read and captured optically, are subsequently compared to a stored reference value, and a difference calculated therefrom is released for forming a signal which has a stopping or corrective effect on the production process of the thread stitching machine so that a functional correlation which is easy to grasp can develop.

The invention is applied to a thread stitching machine comprised of a transfer apparatus arranged upstream of the sewing apparatus, on which transfer apparatus the straddled printed sheets are conveyed one behind the. An optoelectrical reading apparatus is arranged within the transfer apparatus, are conveyed along the transfer apparatus by a driving mechanism that contacts acting approximately at a right angle with respect to the direction of movement of the printed sheets and is associated with a checking apparatus. The printed sheets in the inner fold edge of the printed sheets.

It turns out that a transfer apparatus is suitable which is provided with support surfaces which are sloping downward on the sides and which are configured to be discontinuous or to have a window-like recess in the reading region of the reading apparatus.

Advisably, the reading apparatus is connected to a comparator apparatus, configured as electronic computer, which can receive/store a stored desired value which is variable.

Preferably, the comparator apparatus is connected to a control which, in response to signals from the comparator apparatus, can influence the stitching process, the transfer apparatus or the thread stitching machine between feeding at the separating apparatus and sewing apparatus, i. e., can interrupt or correct the processing process.

BRIEF DESCRIPTION OF THE DRAWING

The invention is described below by way of an embodiment with reference to the drawing to which reference is made expressly with respect to all details that are not specifically mentioned in the description. The drawing shows.

DETAILED DESCRIPTION OF THE DRAWINGS

Figure 1:
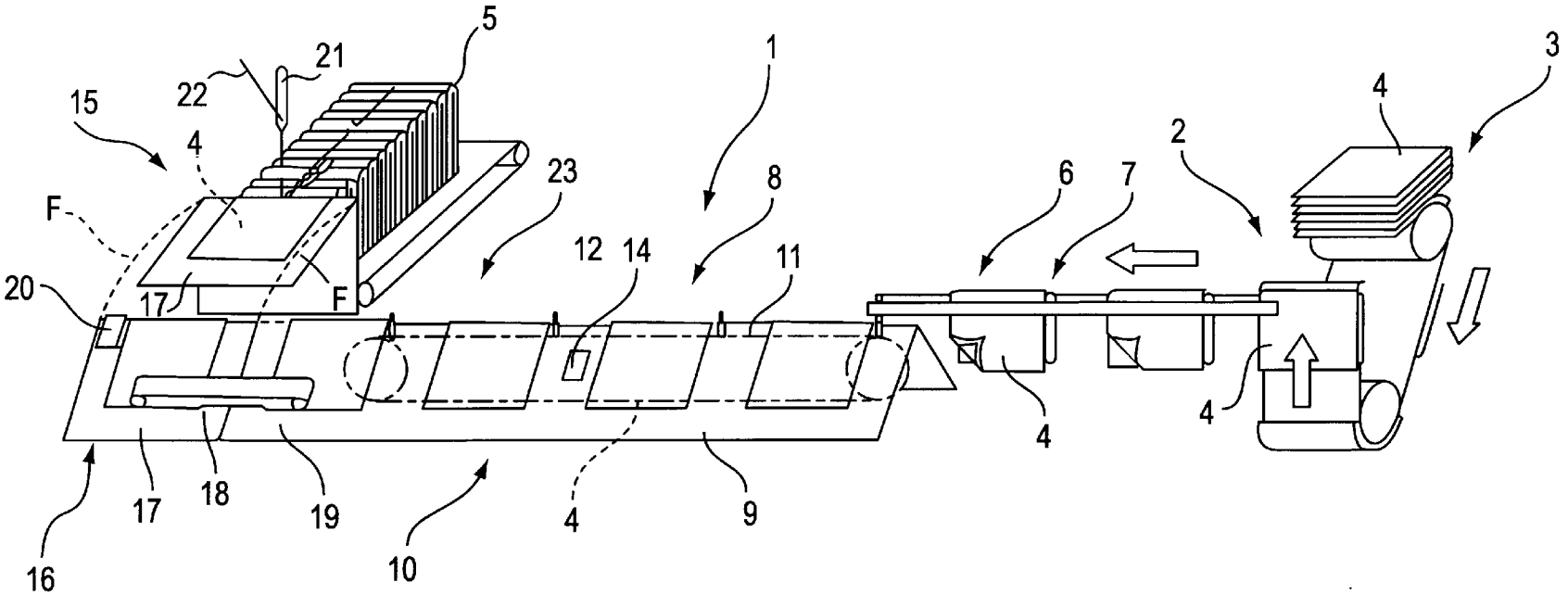
FIG. 1 a schematic side view of a thread stitching machine.

FIG. 1 illustrates a thread stitching machine 1 having a printed sheet feeder 2 which is provided with a magazine 3 in which the printed sheets 4 are made available stacked one on top of the other in the sequence of a book block 5 to be produced. The printed sheets 4 are grasped separately and pulled off at the underside of the stack by suction devices, grippers (not shown) or the like and forwarded to a conveyor 6. The latter passes through an opening station 7 in which the printed sheets 4 are grasped from the sides (for example, by suction devices) and transferred astride in straddled position to a transfer apparatus 8. The transfer apparatus 8 is provided with a stationary support element 10 which extends in the direction of conveyance and has laterally sloping support surfaces 9, and carriers 12 cooperating with the support element and fastened to an endlessly circulating traction means 11. The carriers 12 transport the printed sheets 4 on the support element 10 in a sliding manner past an optoelectrical reading apparatus 13—see also FIG. 2—of a checking apparatus—which will be explained below.

Because of the arrangement and operation of the reading apparatus 13, the latter is allocated a recess 14 at least on one support surface 9 of the support element 10. The conveying end of the support element 10 or the transfer apparatus 8 is connected so as to produce a conveying effect to a stitching saddle 16 associated with a sewing apparatus 15 of the thread stitching machine 1, for which purpose the support surfaces 9 of the support element 10 form a coplanar plane with the stitching saddle 16. A run 18 of a circulating drive belt 19 extends above the one support surface 9 and contact face 17 of the stitching saddle 16 for the forward transport of the printed sheet 4 to the stitching saddle 16 where it rests against a stop 20.

By way of a swinging movement according to the dashed curved lines F, the stitching saddle 16 places the printed sheet into the binding position in which the sewing process takes place (as known from the prior art). The sewing together of the printed sheets 4 for the formation of book blocks is indicated by an illustrated needle 21 and a twine 22. With the sewing process, the book blocks 5 are carried away continuously by means of a conveyor belt 23.

Figure 2:
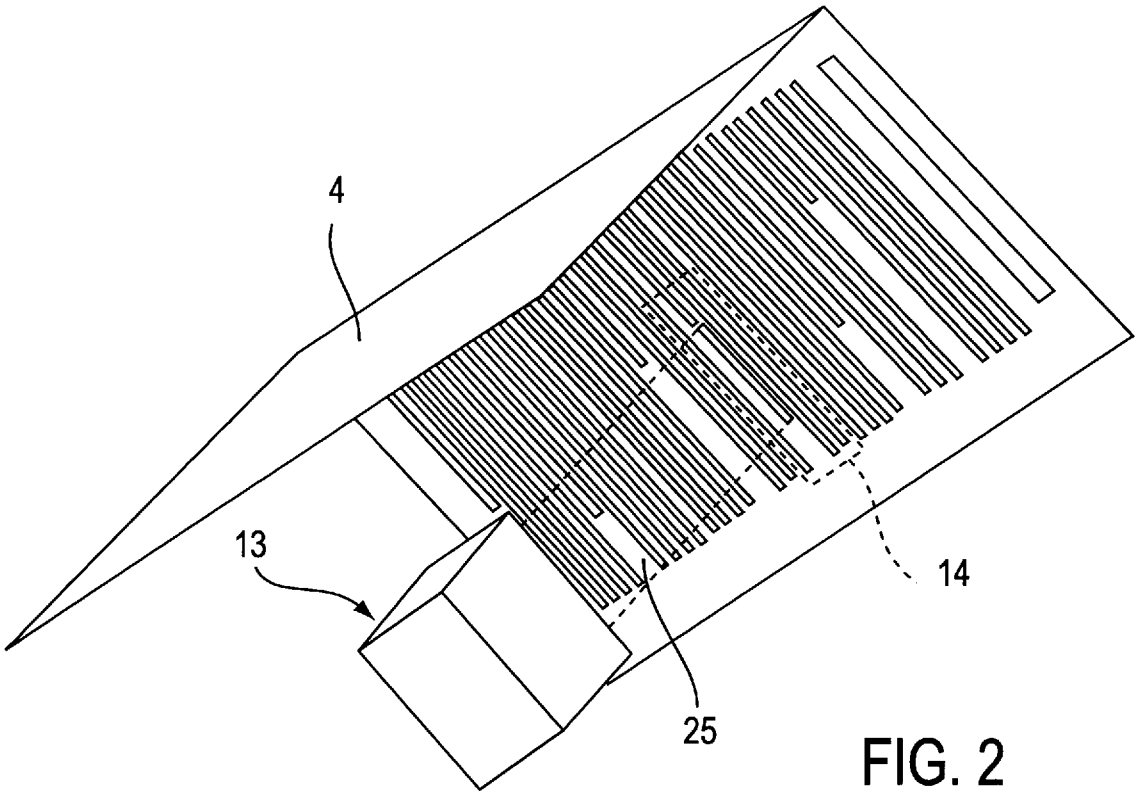
FIG. 2 a view of the underside of a printed sheet.

FIG. 2 shows the a printed sheet 4 in the region of a recess 14 through which an emitted light beam 25, is applied approximately perpendicular to the underside of printed sheet 4. The light is reflected by the printed sheet 4 and received by a reading apparatus 13. The evaluation of the light beam 25 takes place in a comparison apparatus, not shown, which calculates differences that form a signal which is used for the control of the checking apparatus.

We claim:

1. A method for producing book blocks composed of folded printed sheets each of which has different print images, the method comprising:

supplying the printed sheets separately according to a specific sequence to a sewing apparatus of a thread stitching machine for stitching to one another by at least one twine which extends through a fold of the printed sheets guiding the printed sheets on a conveying path to the sewing apparatus in straddled position on at least one side forming an inner fold edge of the printed sheet past a checking apparatus capable of checking the print image; and checking the print image on the side forming the inner fold edge with the checking apparatus to determine at least one of the type of sheet, the completeness of the sheet, a processing position of the sheet, and an opening position of the sheet.

2. A method according to claim 1, wherein the checking apparatus comprises an optical apparatus and the checking step includes optically capturing the print image and subsequently comparing the optically captured print image to a stored reference value, calculating a difference therefrom, and utilizing the difference for forming a signal which has a stopping or corrective effect on the the supplying step.

3. An arrangement for producing book blocks composed of folded printed sheets each of which has different print images, comprising:

a thread stitcting machine including a sewing apparatus;

a transfer apparatus arranged upstream of the sewing apparatus of the thread stitching machine, on which transfer apparatus the printed sheets are straddled means for conveying the straddled printed sheets one behind the other on the transfer apparatus toward the thread stitching machine; and an optoelectrical reading apparatus acting approximately at a right angle with respect to a direction of movement of the printed sheets arranged within the transfer apparatus for optically capturing the printed image on an inner side of the straddled printed sheet and supplying a signal representing the printed image to a checking device for checking one of the type of sheet, the completeness of the sheet, a processing position of the sheet, and an opening position of the sheet.

4. The arrangement according to claim 3, wherein the transfer apparatus includes downwardly sloping support surfaces configured to be discontinuous or to have a window-like recess in a reading region of the reading apparatus.

5. The arrangement according to claim 3, further including a comparator apparatus having a stored, desired value to which the reading apparatus is connected for comparing the signal representing the printed image to the stored, desired value.

6. The arrangement according to claim 5, further including a control for acting on the transfer apparatus or the thread stitching machine in response to an output from the comparator apparatus.

* * * * *